US011051607B1

(12) United States Patent
Joyner

(10) Patent No.: US 11,051,607 B1
(45) Date of Patent: Jul. 6, 2021

(54) PAINTING SYSTEM

(71) Applicant: Dwight Joyner, Staten Island, NY (US)

(72) Inventor: Dwight Joyner, Staten Island, NY (US)

( * ) Notice: Subject to any disclaimer, the term of this patent is extended or adjusted under 35 U.S.C. 154(b) by 23 days.

(21) Appl. No.: 16/708,583

(22) Filed: Dec. 10, 2019

(51) Int. Cl.
*A46B 11/06* (2006.01)
*A46B 11/00* (2006.01)

(52) U.S. Cl.
CPC ..... *A46B 11/063* (2013.01); *A46B 11/0006* (2013.01); *A46B 11/0079* (2013.01); *A46B 2200/202* (2013.01)

(58) Field of Classification Search
CPC ..... A46B 11/063; A46B 11/0006; A46B 2200/202; A46B 11/00; A46B 11/0017; A46B 11/0055; A46B 11/0072; A46B 11/0079; B05C 17/00; B05C 17/005; B05C 17/00569; B05C 17/00506
USPC ..... 401/188 R, 268–270, 282, 286, 289
See application file for complete search history.

(56) References Cited

U.S. PATENT DOCUMENTS 3,284,838 A 11/1966 Joseph
3,503,691 A 3/1970 Kirch
3,640,630 A 2/1972 Walker
4,676,685 A 6/1987 Murphy
D292,649 S 11/1987 Engleman
5,054,947 A * 10/1991 Frank ..... B05C 17/0333 401/146
5,246,302 A 9/1993 Wey
5,772,116 A * 6/1998 Holt ..... B05B 7/02 239/124
5,904,434 A 5/1999 Bekius
8,430,592 B2 4/2013 Castellana
D741,372 S 10/2015 Smith, Sr.
2006/0120794 A1* 6/2006 Scott ..... B05C 17/002 401/188 R

FOREIGN PATENT DOCUMENTS

GB 2182843 4/1989

* cited by examiner

*Primary Examiner* — David J Walczak
(74) *Attorney, Agent, or Firm* — Kyle A. Fletcher, Esq.

(57) ABSTRACT

The painting system comprises a paint brush, a brush hose, a pump, a power source, a cap, and a suction hose. Paint may be pumped from a paint can to the paint brush by the pump such that the paint brush may continuously apply the paint to a surface without necessitating that bristles of the paint brush be dipped into the paint can. The cap may couple to the top of the paint can to retain the suction hose in position within the paint can. A bristle attachment of the paint brush may be detached so that the bristle attachment may be cleaned or replaced. A sprayer attachment may be coupled to the handle in place of the bristle attachment and may be activated to spray paint the surface.

18 Claims, 4 Drawing Sheets

PAINTING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of painting equipment, more specifically, a painting system.

Summary of Invention

The painting system comprises a paint brush, a brush hose, a pump, a power source, a cap, and a suction hose. Paint may be pumped from a paint can to the paint brush by the pump such that the paint brush may continuously apply the paint to a surface without necessitating that bristles of the paint brush be dipped into the paint can. The cap may couple to the top of the paint can to retain the suction hose in position within the paint can. A bristle attachment of the paint brush may be detached so that the bristle attachment may be cleaned or replaced. A sprayer attachment may be coupled to the handle in place of the bristle attachment and may be activated to spray paint the surface.

An object of the invention is to pump paint from a paint can to a paint brush such that the paint brush may be used continuously without having to reload paint onto the bristles of the paint brush.

Another object of the invention is to provide a paint brush comprising detachable bristle attachments of multiple shapes and a handle.

A further object of the invention is to provide a pump, motor, paint can cap, suction hose, and brush hose to move the paint from the paint can to the paint brush.

Yet another object of the invention is to provide a sprayer attachment that may be coupled to the handle in place of the bristle attachment.

These together with additional objects, features and advantages of the painting system will be readily apparent to those of ordinary skill in the art upon reading the following detailed description of the presently preferred, but nonetheless illustrative, embodiments when taken in conjunction with the accompanying drawings.

In this respect, before explaining the current embodiments of the painting system in detail, it is to be understood that the painting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the painting system.

It is therefore important that the claims be regarded as including such equivalent construction insofar as they do not depart from the spirit and scope of the painting system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
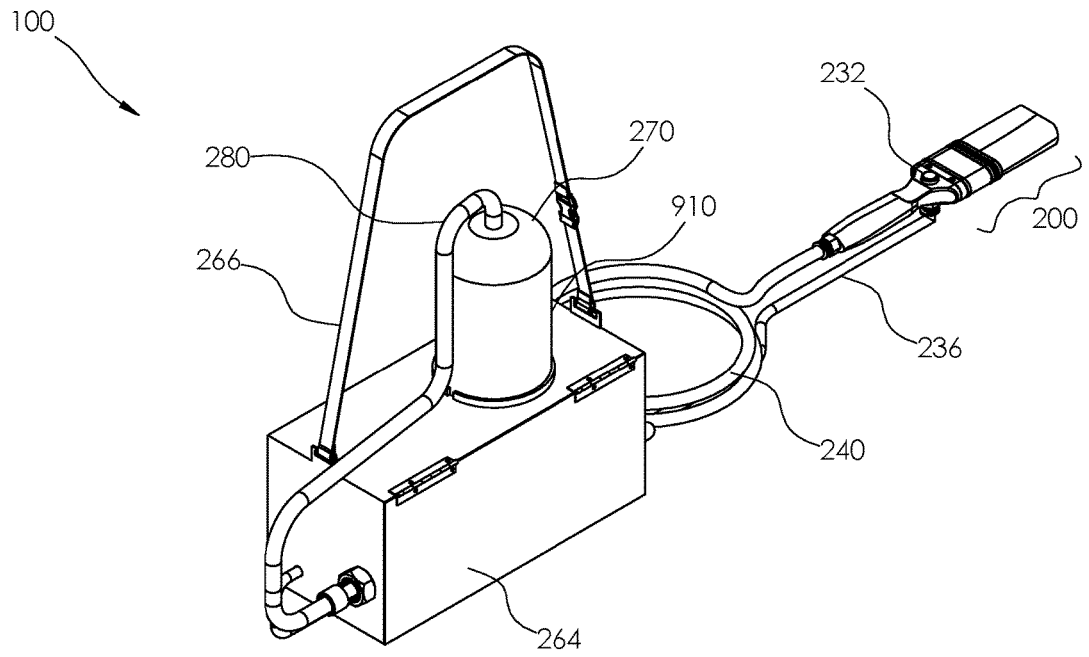
FIG. 1 is an isometric view of an embodiment of the disclosure.
Figure 2:
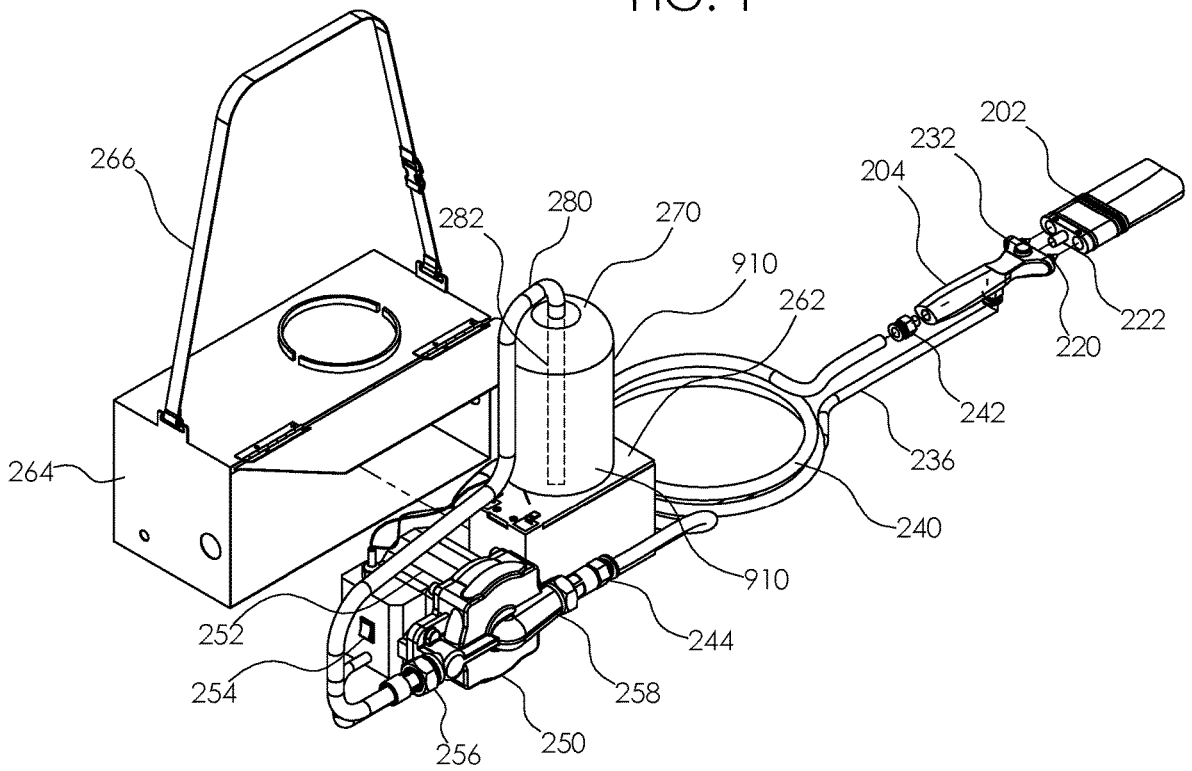
FIG. 2 is an isometric view of an embodiment of the disclosure removed from the carrying case.
Figure 3:
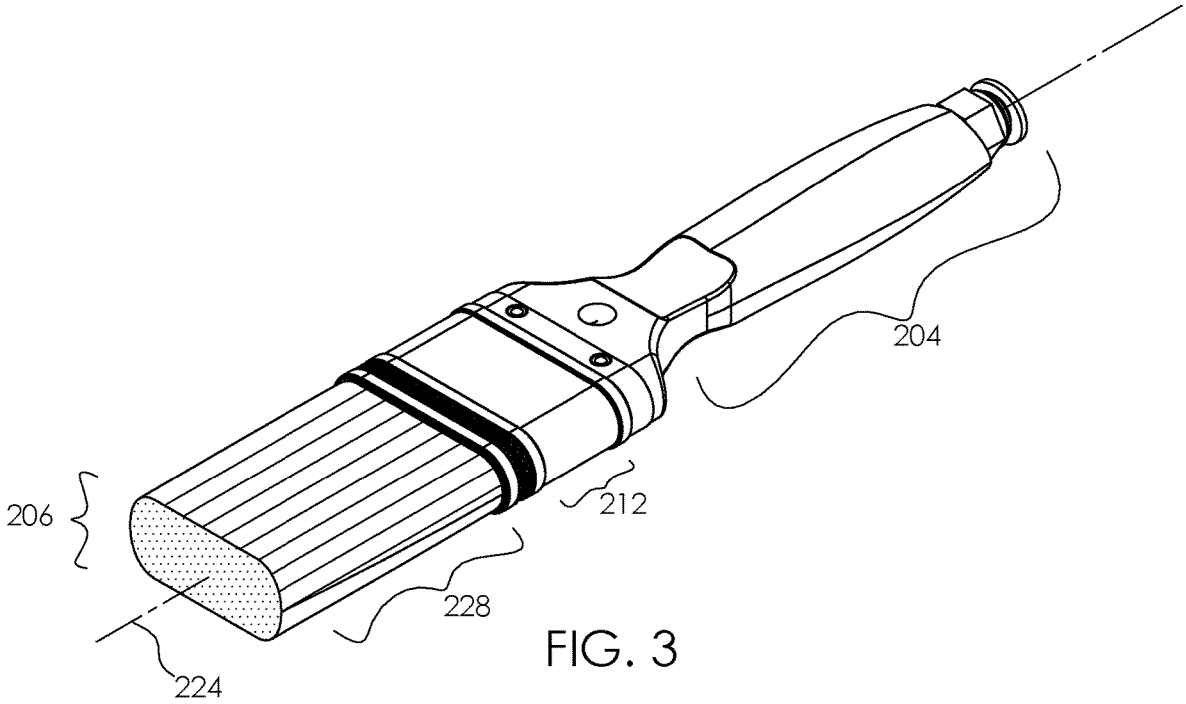
FIG. 3 is an isometric view of an embodiment of the disclosure illustrating a straight edge paint brush.
Figure 4:
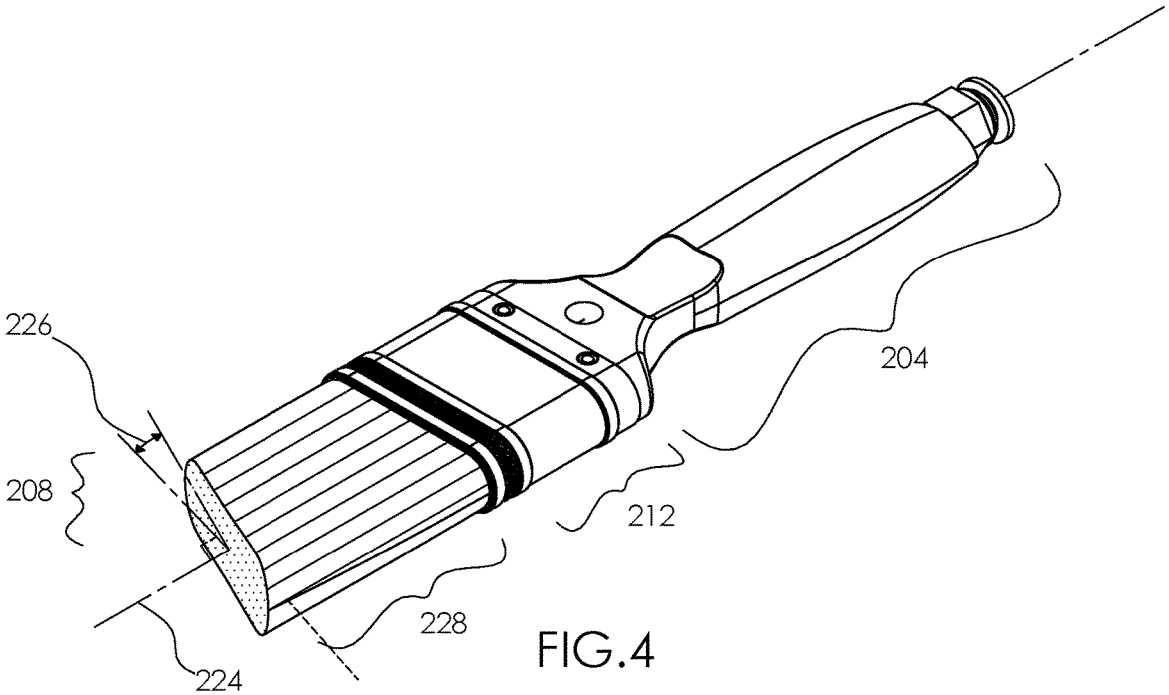
FIG. 4 is an isometric view of an embodiment of the disclosure illustrating an angled edge paint brush.
Figure 5:
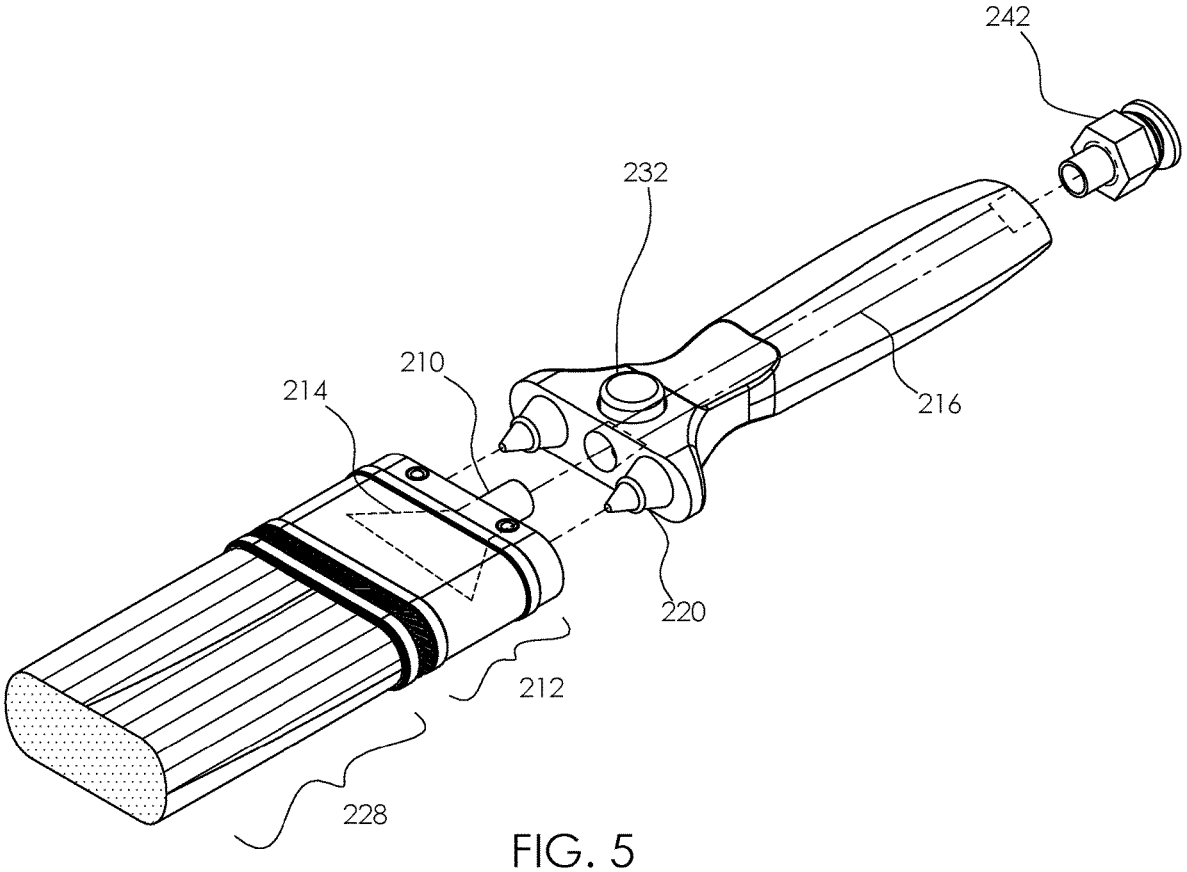
FIG. 5 is an exploded view of an embodiment of the disclosure illustrating the paint brush.
Figure 6:
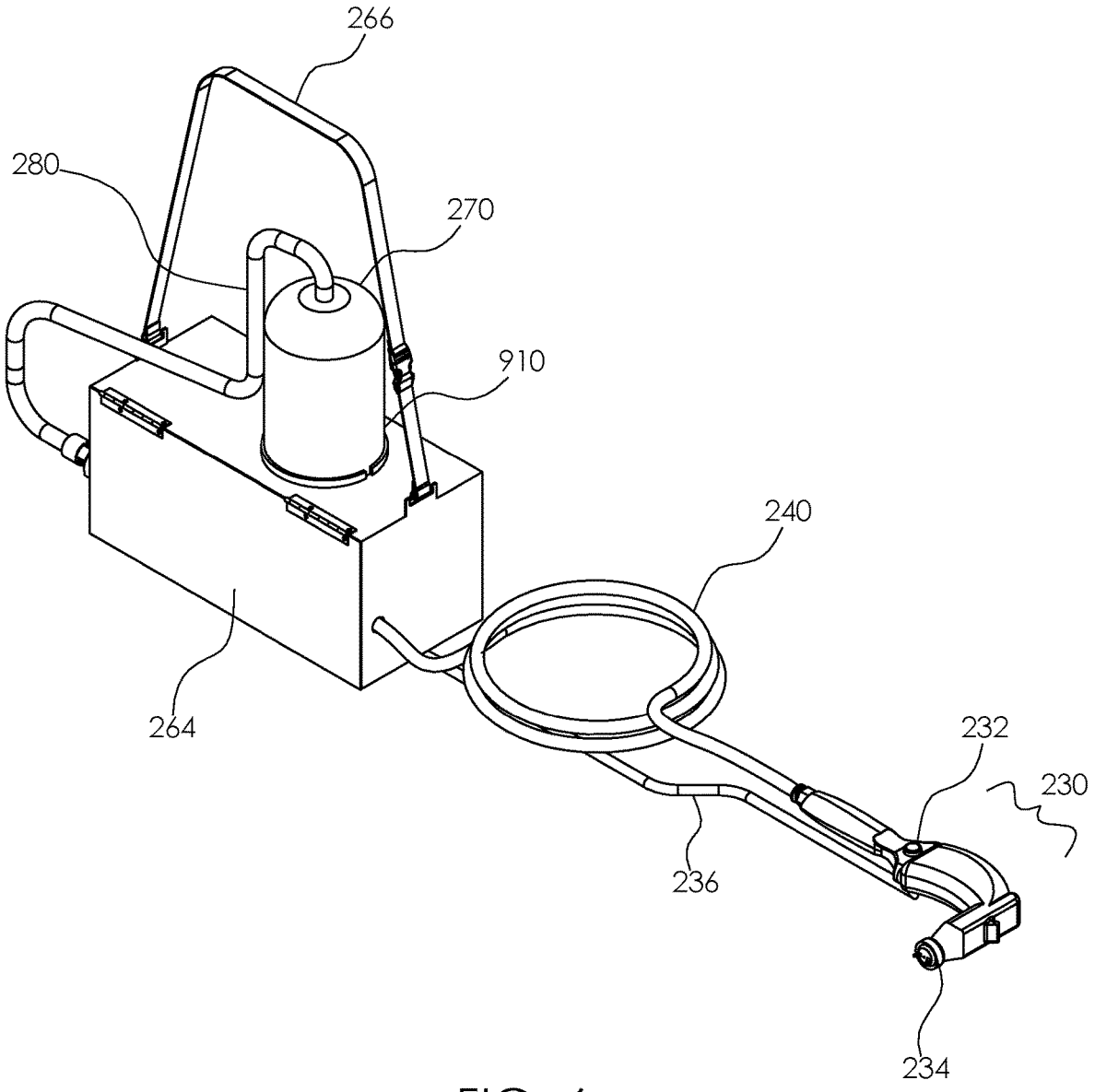
FIG. 6 is an isometric view of an embodiment of the disclosure illustrating the spray attachment in place on the handle.

Detailed reference will now be made to a first potential embodiment of the disclosure, which is illustrated in FIGS. 1 through 6.

The painting system 100 (hereinafter invention) comprises a paint brush 200, a brush hose 240, a pump 250, a power source, a cap 270, and a suction hose 280. Paint may be pumped from a paint can 910 to the paint brush 200 by the pump 250 such that the paint brush 200 may continuously apply the paint to a surface without necessitating that bristles 228 of the paint brush 200 be dipped into the paint can 910. The cap 270 may couple to the top of the paint can 910 to retain the suction hose 280 in position within the paint can 910. A bristle attachment 202 of the paint brush 200 may be detached so that the bristle attachment 202 may be cleaned or replaced.

The paint brush 200 may comprise the bristle attachment 202 and a handle 204. The paint brush 200 may be operable to apply the paint to the surface as the bristles 228 located at the distal end of the paint brush 200 are brushed against the surface.

The bristle attachment 202 may comprise the bristles 228 and a ferrule 212. The bristle attachment 202 may be located at the distal end of the paint brush 200. A paint manifold 214 located within the ferrule 212 may accept the paint from the handle 204 and distribute the paint to the bristles 228. The ferrule 212 may retain the bristles 228. The bristle attachment 202 may couple to the handle 204. In some embodiments, the bristles 228 may be cut to form a straight edge 206 where the distal ends of the bristles 228 end in a plane that is oriented perpendicularly to a longitudinal axis 224 of the paint brush 200. In some embodiments, the bristles 228 may be cut to form an angle edge 208 where the distal ends of the bristles 228 end in a plane that is canted at an oblique lateral angle 226 from being perpendicular to the longitudinal axis 224 of the paint brush 200.

The handle 204 may be adapted to be held by a painter. A proximal end of the handle 204 may couple to the brush hose 240.

A distal end of the handle 204 may couple to the bristle attachment 202. A paint feed tube 216 may pass through the handle 204 longitudinally to convey the paint from the brush hose 240 to the bristle attachment 202.

Alignment of the handle 204 and the bristle attachment 202 may be established by guiding one or more alignment pins 220 on the handle 204 into one or more alignment apertures 222 on the bristle attachment 202. Those skilled in the art will recognize that the locations of certain components may be changed without departing from the spirit and scope of the invention 100. As a non-limiting example, the location of the one or more alignment pins 220 and the one or more alignment apertures 222 may be reversed such that the one or more alignment apertures 222 are located on the handle 204 and the one or more alignment pins 220 are located on the bristle attachment 202.

A bristle coupling 210 may detachably couple the paint manifold 214 of the bristle attachment 202 and the paint feed tube 216 of the handle 204. In some embodiments, the bristle coupling 210 may be a quick disconnect single shut off coupling or a quick disconnect double shut off coupling such that the paint does not leak from the bristle attachment 202, from the handle 204, or both when the bristle attachment 202 is removed from the handle 204.

The brush hose 240 may be a conduit for the paint to travel from the pump 250 to the paint brush 200. The brush hose 240 may be made from flexible tubing. The brush hose 240 may comprise a pump coupling 244 and a brush coupling 242. The pump coupling 244 may detachably couple the brush hose 240 to an outlet 258 of the pump 250. The brush coupling 242 may detachably couple the brush hose 240 to the handle 204 of the paint brush 200. In some embodiments, the brush coupling 242 may be a quick disconnect single shut off coupling or a quick disconnect double shut off coupling such that the paint does not leak from the brush hose 240, from the handle 204, or both when the brush hose 240 is removed from the handle 204.

The pump 250 may move the paint from an inlet 256 to the outlet 258. As non-limiting examples, the pump 250 may move the paint by applying rotary motion, reciprocating motion, linear motion, or a combination thereof to one or more gears, screws, pistons, shuttle blocks, vanes, diaphragms, plungers, chains, ropes, impellers, or combinations thereof. The pump 250 may be driven by a motor 252 when an electrical potential is applied to the motor 252.

Operation of the pump 250 may be controlled by one or more operator controls 254. As non-limiting examples, the one or more operator controls 254 may determine an on/off state of the motor 252, may determine a flow rate of the paint, or both.

The power source may provide the electrical potential to energize the motor 252 of the pump 250. In some embodiments, the power source may comprise one or more batteries 262. The one or more batteries 262 may comprise one or more energy-storage devices. The one or more batteries 262 may be a source of electrical energy to operate the motor 252. The one or more batteries 262 may be replaceable or rechargeable.

The cap 270 may couple to the top of the paint can 910 when the paint can 910 is open. The cap 270 may prevent spills. The suction hose 280 may be a non-collapsible tube. The suction hose 280 may couple to the inlet 256 of the pump 250.

A siphon tube 282 may extend to the bottom of the paint can 910 so that the paint may be drawn from the bottom of the paint can 910. In embodiments, the siphon tube 282 may be integral to the suction hose 280, extending through the cap 270, or the siphon tube 282 may be integral to the cap 270, coupling to the suction hose 280 at the cap 270.

In some embodiments, the bristle attachment 202 may be removed and replaced by a sprayer attachment 230. In such embodiments, an air hose 236 may provide air to the handle 204 and a spray trigger 232 located on the handle 204 may activate the sprayer attachment 230. When the spray trigger 232 is activated, a mixture of paint and air may be expelled from a spray nozzle 234. The mixture of paint and air may be directed towards the surface while the sprayer attachment 230 is repeatedly passed over the surface.

In some embodiments, the invention 100 may comprise a carrying case 264. The pump 250, the motor 252, and the one or more batteries 262 may be adapted to be transported within the carrying case 264 while in use by placing a carrying strap 266 of the carrying case 264 over the shoulder of the painter.

In use, the paint can 910 is opened and the cap 270 is placed onto the paint can 910. The suction hose 280 is coupled to the cap 270. The bristle attachment 202 is coupled to the handle 204 and the handle 204 is coupled to the brush hose 240. The one or more operator controls 254 may be set to establish desired operating parameters. As non-limiting examples, the one or more operator controls 254 may be used to start or stop the operation of the pump 250 or to set the flow rate of the paint. The paint brush 200 may be used by the painter to apply the paint to the surface by brushing the bristles 228 against the surface. In some embodiments, the paint brush 200 may be detached and/or replaced or the bristle attachment 202 may be detached and/or replaced while the pump 250 is running without the paint leaking.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "bristle" is a short coarse stiff hair or hair like object.

As used in this disclosure, a "brush" is a device comprising a plurality of bristles set into a handle or a base that is used for grooming, sweeping, smoothing, scrubbing, cleaning, or painting.

As used in this disclosure, a "cant" is an angular deviation from one or more reference planes such as a vertical plane or a horizontal plane.

As used in this disclosure, a "conduit" is a tube, pipe or hose that is used to transport a fluid or a gas or is used to route, enclose, and protect permanently installed electrical cables.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used herein, the word "desired" refers to a specific value or action within a range of supported values or action. A "desired" value or action indicates that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used herein, "energize" and/or "energization" refer to the application of an electrical potential to a system or subsystem.

As used in this disclosure, "flexible" refers to an object or material which will deform when a force is applied to it, which will not return to its original shape when the deforming force is removed, and which may not retain the deformed shape caused by the deforming force.

As used in this disclosure, a "handle" is an object by which a tool, object, or door is held or manipulated with the hand.

As used in this disclosure, the word "lateral" refers to the sides of an object or movement towards a side. Lateral directions are generally perpendicular to longitudinal directions. "Laterally" refers to movement in a lateral direction.

As used herein, the word "longitudinal" or "longitudinally" refers to a lengthwise or longest direction.

As used in this disclosure, a "manifold" is a pipe or chamber having several ports through which liquid or gas is gathered or distributed.

As used in this disclosure, a "motor" refers to a device that transforms energy from an external power source into mechanical energy.

As used in this disclosure, when used as a noun the term "paint" refers to a pigment based colloid or solution that is applied to a surface as a coating of the surface. When used as a verb, the term paint refers to the application of paint to a surface.

As used in this disclosure, a "pump" is a mechanical or electromechanical device that uses suction or pressure to raise or move fluids, compress fluids, or force a fluid into an inflatable object. As non-limiting examples, fluids may include both liquids, such as water, and gases, such as air.

As used in this disclosure, a "tube" is a hollow cylindrical device that is used for transporting liquids and/or gases. In this disclosure, the terms inner diameter and outer diameter are used as they would be used by those skilled in the plumbing arts. The line that connects the center of the first base of the cylinder to the center of the second base of the cylinder and is equidistant from the outer surface of the tube for its entire length is referred to as the centerline of the tube. When two tubes share the same centerline, they are said to be aligned. When the centerlines of two tubes are perpendicular to each other, the tubes are said to be perpendicular to each other. As used here, "tubing" refers to a tube that is flexible or resilient.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A painting system comprising:

a paint brush, a brush hose, a pump, a power source, a cap, and a suction hose;

wherein paint is pumped from a paint can to the paint brush by the pump such that the paint brush continuously applies the paint to a surface without necessitating that bristles of the paint brush be dipped into the paint can;

wherein the cap couples to a top of the paint can to retain the suction hose in position within the paint can;

wherein a bristle attachment of the paint brush is detachable;

wherein the paint brush comprises the bristle attachment and a handle;

wherein the paint brush is operable to apply the paint to the surface as the bristles located at a distal end of the paint brush are brushed against the surface;

wherein the bristle attachment may be removed and replaced by a sprayer attachment;

wherein an air hose provides air to the handle;

wherein a spray trigger located on the handle activates the sprayer attachment;

wherein when the spray trigger is activated, a mixture of paint and air is expelled from a spray nozzle.

2. The painting system according to claim 1 wherein the bristle attachment comprises the bristles and a ferrule;

wherein the bristle attachment is located at the distal end of the paint brush;

wherein a paint manifold located within the ferrule accepts the paint from the handle and distributes the paint to the bristles;

wherein the ferrule retains the bristles;

wherein the bristle attachment couples to the handle.

3. The painting system according to claim 2 wherein the bristles are cut to form a straight edge where distal ends of the bristles end in a plane that is oriented perpendicularly to a longitudinal axis of the paint brush.

4. The painting system according to claim 2 wherein the bristles are cut to form an angle edge where distal ends of the bristles end in a plane that is canted at an oblique lateral angle from being perpendicular to a longitudinal axis of the paint brush.

5. The painting system according to claim 2 wherein the handle is adapted to be held by a painter;

wherein a proximal end of the handle couples to the brush hose;

wherein a distal end of the handle couples to the bristle attachment;

wherein a paint feed tube passes through the handle longitudinally to convey the paint from the brush hose to the bristle attachment.

6. The painting system according to claim 5 wherein alignment of the handle and the bristle attachment is established by guiding one or more alignment pins on the handle into one or more alignment apertures on the bristle attachment.

7. The painting system according to claim 6 wherein a bristle coupling detachably couples the paint manifold of the bristle attachment and the paint feed tube of the handle.

8. The painting system according to claim 7 wherein the bristle coupling is a quick disconnect single shut off coupling or a quick disconnect double shut off coupling such that the paint does not leak from the bristle attachment, from the handle, or both when the bristle attachment is removed from the handle.

9. The painting system according to claim 7 wherein the brush hose is a conduit for the paint to travel from the pump to the paint brush;

wherein the brush hose is made from flexible tubing;

wherein the brush hose comprises a pump coupling and a brush coupling;

wherein the pump coupling detachably couples the brush hose to an outlet of the pump;

wherein the brush coupling detachably couples the brush hose to the handle of the paint brush.

10. The painting system according to claim 9 wherein the brush coupling is a quick disconnect single shut off coupling or a quick disconnect double shut off coupling such that the paint does not leak from the brush hose, from the handle, or both when the brush hose is removed from the handle.

11. The painting system according to claim 9 wherein the pump moves the paint from an inlet to the outlet;

wherein the pump moves the paint by applying rotary motion, reciprocating motion, linear motion, or a combination thereof to one or more gears, screws, pistons, shuttle blocks, vanes, diaphragms, plungers, chains, ropes, impellers, or combinations thereof;

wherein the pump is driven by a motor when an electrical potential is applied to the motor.

12. The painting system according to claim 11 wherein operation of the pump is controlled by one or more operator controls.

13. The painting system according to claim 12 wherein the one or more operator controls determine an on/off state of the motor, determine a flow rate of the paint, or both.

14. The painting system according to claim 13 wherein the power source provides the electrical potential to energize the motor of the pump.

15. The painting system according to claim 14 wherein the power source comprises one or more batteries;

wherein the one or more batteries comprise one or more energy-storage devices;

wherein the one or more batteries are a source of electrical energy to operate the motor;

wherein the one or more batteries are replaceable or rechargeable.

16. The painting system according to claim 15 wherein the cap couples to the top of the paint can when the paint can is open;

wherein the cap prevents spills;

wherein the suction hose is a non-collapsible tube;

wherein the suction hose couples to the inlet of the pump;

wherein a siphon tube extends to a bottom of the paint can so that the paint is drawn from the bottom of the paint can.

17. The painting system according to claim 16 wherein the siphon tube is integral to the suction hose, extending through the cap, or the siphon tube is integral to the cap, coupling to the suction hose at the cap.

18. The painting system according to claim 17 further comprising a carrying case;

wherein the pump, the motor, and the one or more batteries are adapted to be transported within the carrying case while in use by placing a carrying strap of the carrying case over the shoulder of the painter.

* * * * *